US008827104B2

(12) United States Patent
Hickox

(10) Patent No.: US 8,827,104 B2
(45) Date of Patent: Sep. 9, 2014

(54) APPARATUS AND METHOD FOR PROVIDING FOODS IN ADJACENT PORTABLE CONTAINERS

(71) Applicant: Mary Hickox, McKinney, TX (US)

(72) Inventor: Mary Hickox, McKinney, TX (US)

( * ) Notice: Subject to any disclaimer, the term of this patent is extended or adjusted under 35 U.S.C. 154(b) by 0 days.

(21) Appl. No.: 13/832,273

(22) Filed: Mar. 15, 2013

(65) Prior Publication Data

US 2013/0277375 A1 Oct. 24, 2013

Related U.S. Application Data

(60) Provisional application No. 61/637,710, filed on Apr. 24, 2012.

(51) Int. Cl.
*A47G 23/06* (2006.01)

(52) U.S. Cl.
CPC ..... *A47G 23/06* (2013.01); *A47G 23/0633* (2013.01)
USPC ..... 220/575; 220/23.83; 220/751; 220/694

(58) Field of Classification Search
USPC ..... 220/575, 751, 23.4, 482, 23.86, 735, 220/23.83
See application file for complete search history.

(56) References Cited

U.S. PATENT DOCUMENTS 2,278,401 A 8/1939 Micari
2,314,835 A * 3/1943 Johns et al. ..... 220/23.4
3,219,226 A 11/1965 Schroeder
3,850,398 A 11/1974 Kantor
4,436,217 A 3/1984 Ritter
4,535,921 A 8/1985 Sanders
D302,050 S 7/1989 Ingrisani
4,854,466 A * 8/1989 Lane, Jr. ..... 220/23.83
4,989,742 A 2/1991 Powell
5,184,750 A 2/1993 Moller
5,261,577 A * 11/1993 Goldstein et al. ..... 220/697
5,335,787 A 8/1994 Finchum et al.
5,429,262 A * 7/1995 Sharkey ..... 220/23.83
5,651,523 A 7/1997 Bridges
5,687,873 A * 11/1997 Jones ..... 220/736
D405,574 S * 2/1999 Riky ..... D32/54
5,924,615 A * 7/1999 McGarrah ..... 224/404
5,931,431 A 8/1999 Stinnett
6,076,700 A * 6/2000 Manges ..... 220/751
6,152,362 A * 11/2000 Rosenfeld ..... 229/400
6,193,201 B1 2/2001 Babcock
D444,278 S * 6/2001 Myers, Jr. ..... D32/54
6,264,026 B1 7/2001 Bradley
6,321,929 B1 11/2001 Weshler et al.
6,394,297 B1 * 5/2002 Nance ..... 220/23.4
6,533,232 B1 3/2003 Aggeler
6,601,813 B1 8/2003 Kager et al.
6,606,996 B1 8/2003 Thornell et al.
6,783,021 B2 * 8/2004 Kaura ..... 220/482
7,021,825 B1 4/2006 Schultz
D531,054 S 10/2006 Sagel
D623,019 S 9/2010 Wildman (Continued)

*Primary Examiner* — Steven A. Reynolds
(74) *Attorney, Agent, or Firm* — Ryan C. Smith; Larkin Hoffman Daly & Lindgren, Ltd.

(57) ABSTRACT

The invention described herein is generally directed to a snack or dip or food holder assembly that can attach to bowls, dishes, plates, trays and the like. Specifically, a snack or dip holder is provided that can be removeably attached to a bowl or plate edge.

16 Claims, 3 Drawing Sheets

(56) References Cited

U.S. PATENT DOCUMENTS

| | | | | |
|---|---|---|---|---|
| 7,874,449 | B1 | 1/2011 | Studee et al. | |
| 7,980,406 | B2 * | 7/2011 | Liu | 220/23.4 |
| D643,248 | S | 8/2011 | Schmidt | |
| 8,061,545 | B2 * | 11/2011 | Roth et al. | 220/23.4 |
| 8,443,996 | B2 * | 5/2013 | Ciarrocchi, Jr. | 220/23.4 |
| 2003/0019871 | A1 * | 1/2003 | Nance | 220/23.4 |
| 2004/0031796 | A1 * | 2/2004 | Krueger et al. | 220/23.4 |
| 2006/0086756 | A1 * | 4/2006 | Roth et al. | 222/129 |
| 2007/0205199 | A1 * | 9/2007 | Wothers | 220/506 |
| 2008/0035655 | A1 * | 2/2008 | Baumgartner | 220/751 |
| 2009/0090710 | A1 * | 4/2009 | Nielsen | 220/23.4 |
| 2009/0108004 | A1 | 4/2009 | Bollengier | |
| 2011/0084087 | A1 * | 4/2011 | Scribner et al. | 220/751 |
| 2011/0272546 | A1 | 11/2011 | Nielsen | |
| 2012/0097576 | A1 * | 4/2012 | Dold | 206/581 |
| 2012/0199597 | A1 * | 8/2012 | Myoung et al. | 220/751 |
| 2012/0285952 | A1 * | 11/2012 | James et al. | 220/23.4 |

* cited by examiner

APPARATUS AND METHOD FOR PROVIDING FOODS IN ADJACENT PORTABLE CONTAINERS

CLAIM OF PRIORITY TO FILED APPLICATION

The present application claims priority to U.S. Provisional Application No. 61/637,710, filed Apr. 24, 2012, the disclosure of which is hereby incorporated by reference in its entirety.

FIELD OF INVENTION AND BACKGROUND

The invention relates generally to a holding system for conveniently holding chip dips and snacks in bowls.

There are a number of solutions for holding snacks or chips and dip. Some of these solutions attempt to have a saucer that is physically and permanently attached to a bowl, but these solutions fail to meet the needs of the industry because the saucer is unable to detach from the bowl making it difficult to wash and store once the user is finished using it.

It would be advantageous to have an assembly that is designed to be used to hold and carry around snacks and dip. It would also be advantageous to have a saucer that is not permanently attached to a bowl.

SUMMARY

In one example embodiment, a food/dip holder assembly comprises a container member having an interior surface and an exterior surface forming a wall, the interior surface and the exterior surface terminating at a lip portion. Further included is a clamping means adapted to be operatively coupled to said container member in a manner to provide the food/dip holder assembly with a means of being removably attached to a serving member.

In another example embodiment, a food/dip holder assembly comprises a serving member configured to support food thereon, the serving member having a lateral edge. Further included is an attachment means adapted to be operatively coupled to the serving member in a manner to provide the food/dip holder assembly with a means of being removably attached to a second serving member.

In yet another example embodiment, a kit for serving various foods in various serving dishes comprises a serving member having an attachment means operatively coupled thereto, wherein the attachment means is configured to removably attach the serving member to a second serving member. In a related embodiment, the kit includes multiple serving members with attachment means that are configured to fit with each other for ease of storage and portability. Additionally, the kit includes attachment means that is comprised of a lateral or sideways clamping or clip device configured to removably attach the serving member to an edge of the second serving member.

The invention advantageously fills the aforementioned deficiencies by providing a saucer or container that can attach to a bowl or plate which provides a space saving means of holding chips, dip or snacks. The food holder assembly also prevents chips and the like from becoming soggy due to inadvertently coming into contact with a dip or sauce that would otherwise be located in the same receptacle or container or plate.

Among other things, it is advantageous to provide a removably attachable dip and snack holder assembly for plates or trays that do not suffer from any of the problems or deficiencies associated with prior solutions.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Following below are more detailed descriptions of various related concepts related to, and embodiments of, systems, assemblies and methods for serving and porting snacks, sauces and other foods. It should be appreciated that various aspects of the subject matter introduced above an discussed in greater detail below may be implemented in any of numerous ways, as the subject matter is not limited to any particular manner of implementation. Examples of specific implementations and applications are provided primarily for illustrative purposes. One example embodiment of a snack holding and porting assembly is generally directed to a snack or dip holder that attaches to bowls, dishes, plates, trays and the like. Specifically, a snack or dip holder assembly and container that is removably attached to a bowl or other container edge. In a related embodiment, an attachment means for a food holder assembly is provided that includes a lateral clip or clamp so as to "clip" the food holder sideways or laterally to a plate or tray.

Figure 1:
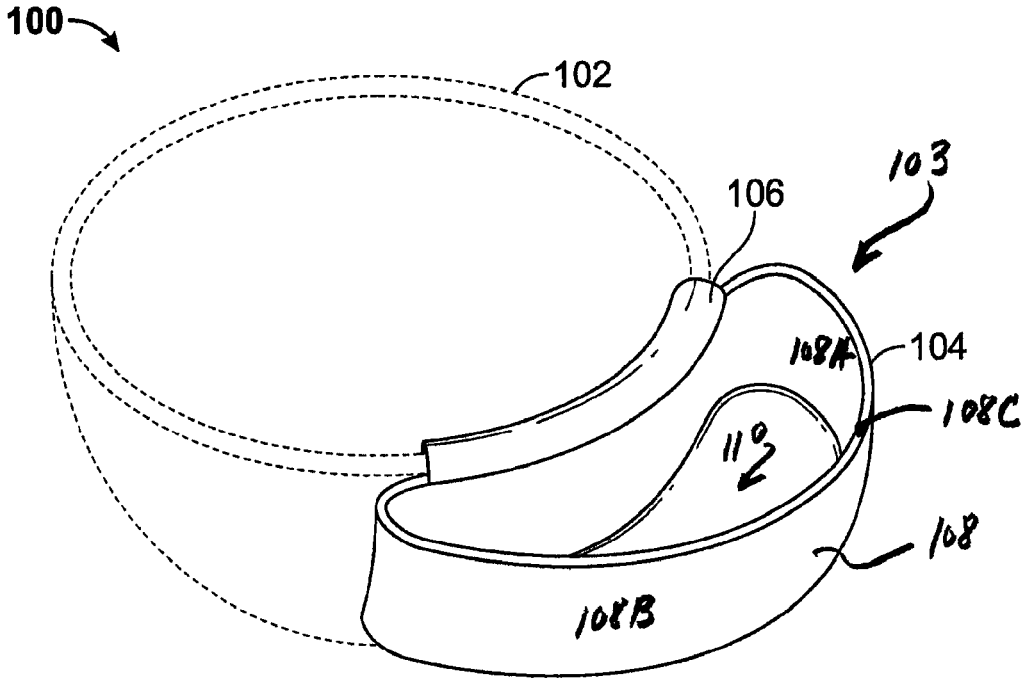
FIG. 1 shows a perspective view of a saucer attached to a bowl according to the teachings herein.
Figure 2:
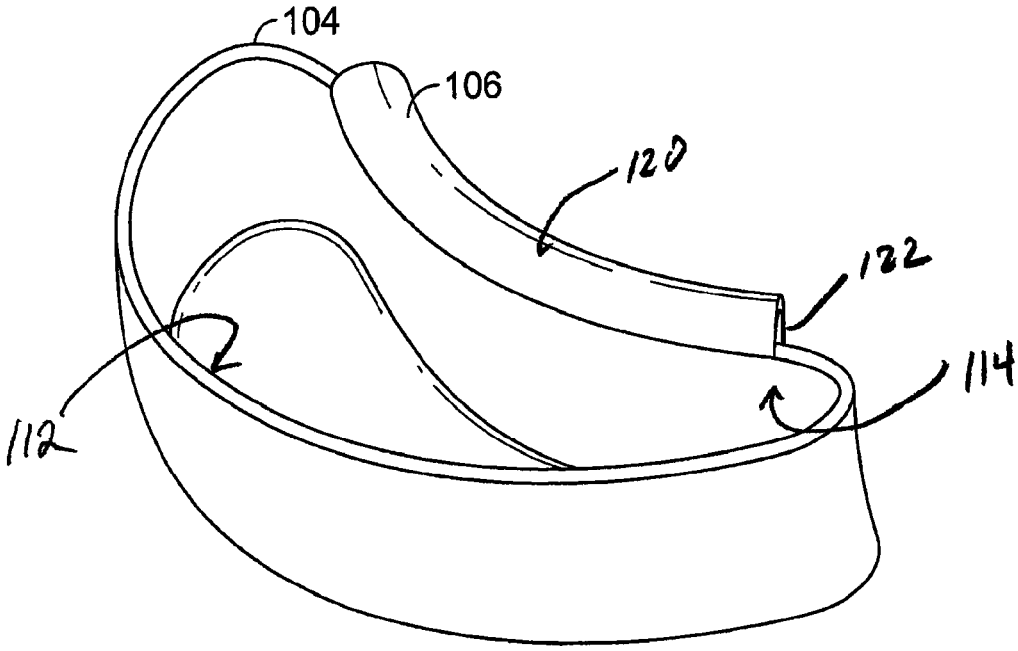
FIG. 2 shows a perspective view of the saucer.

Referring now to the figures, wherein like reference numerals designate identical or corresponding parts through several views, an example embodiment is shown in FIGS. 1 and 2 of a container and food holding system 100 having a bowl 102 and a food/dip holder assembly 103 that generally includes a container 104 and a clamp device 106. Container 104 is typically comprised of a wall 108 and a base 110 having an interior surface 108A and an exterior surface 108B. Interior surface 108A and exterior surface 108B terminate at a lip 108C which forms a top edge portion of food holder assembly 103. In related embodiments, claim 106 includes a hook, hanger or other means for attaching container 104 to another container (such as bowl 102).

In this example embodiment, wall 108 and base 110 are generally comprised of a uniform material throughout a substantial portion of the two components. Similarly, wall 108 and base 110 may be a continuous single molded material. Container 104 may be formed from a number of materials well known by those skilled in the art, such as plastic, glass, ceramic, metal or even paper products. In a related embodiment, container 104 is made from a wax-coated cardboard so as to generate a collapsible and potentially disposable container that can clamp or hang onto another container. In a preferred embodiment, container 104 is made from a nonpermeable synthetic material such as rubber. Other materials such as polyurethane, polyethylene, polypropylene, polyvinylchloride (PVC) and silicone are also within in the scope of the invention.

In yet another related embodiment, a material can be used that is rigid enough to withstand the weight of dips and sauces when being clamped to (or hung onto) a bowl or other shaped container, but that is also pliable enough to allow for easy attachment and removal. Additionally, a material that is microwave and/or dishwasher "safe" is also preferable. Although, not wanting to be bound by a particular structure or shape or configuration, base 110 may also include an additional layer on the external bottom portion to provide a skid-resistant surface and/or a means of handling food or dip holder 103 after being exposed to a heating means, such as a microwave oven. In a related embodiment, the external bottom portion of base 110 is pre-formed with a corrugated surface to make it skid or slip resistant. In yet another related embodiment, the inside surface of clamp 106 is also made to be slip resistant to ensure a better grip to the other container.

Figure 3:
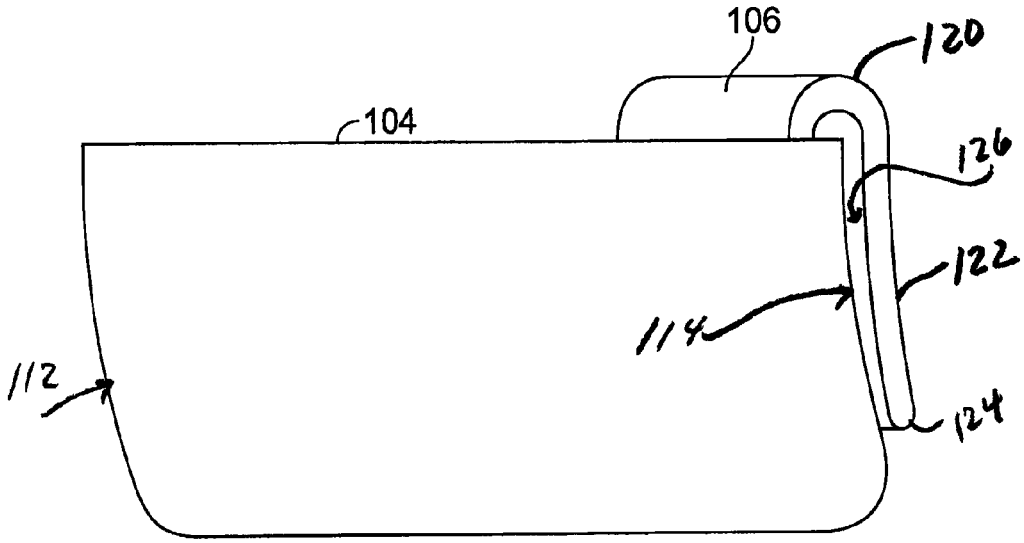
FIG. 3 shows a side elevation view of the saucer.

Referring now to FIGS. 2 and 3, there is shown external surface 108B having a substantially vertical orientation and provides the external shape of food or dip holder 103. In one example embodiment, a portion of the dip or food holder 103 wall 108 and base 100 terminate in a generally rounded manner. Wall 108 may also include a clamp 106 to attach dip holder 103 to a kitchen item, such as a bowl, dish or the like. In a related embodiment, wall 108 is also curved. The curve may be a concave shape 112 on at least one portion of wall 108, with an opposed portion of wall 108 having a convex shape 114, as depicted in FIG. 3. In an alternative embodiment, the opposing wall portions may be similarly shaped with either a convex or a concave orientation (not shown), depending on the style and design desired by the manufacturer and the chip/snack container it will be attached to.

In this example embodiment, clamp 106 generally comprises a top portion 120 and an attachment portion 122. The top portion of clamp 106 is generally elevated from the top horizontal plane of lip 108C. However, top portion 120 may also be in a plane equal to that of the horizontal plane of lip 108C. In another related embodiment, top portion 120 may be below the horizontal plane of lip 108C. In a related embodiment, clamp 106 is configured as a sideways clip or clamp that grabs or fits on the edge of a plate or tray instead of a bowl or container.

Referring again to FIGS. 1 and 2, clamp 106 may be generally concave in shape to conform to a bowl, such as phantom bowl 102. Although the arc angle of clamp 106 may vary, the arc angle should be such as to allow dip holder 103 the ability to conform to the lip surface of a bowl to allow dip holder 103 to easily attach thereto. Similarly, the arc length of clamp 106 may also vary in lengths from about 1 inch to about 10 inches. In another related embodiment, the arc length of clamp 106 is about 2 inch to about 8 inches. In another related embodiment, the arc length of clamp 106 is about 3 inch to about 7 inches. In yet another related embodiment, the arc length of clamp 106 is about 4 inch to about 6 inches. In another related embodiment, the arc length of clamp 106 is about 5 inches.

In other related embodiments, dip holder 103 may also include at least two clamps. When the at least two clamp configuration is utilized (not shown) clamps may be similarly sized or may vary in size to accommodate a particular design or functional feature desired.

In various embodiments, clamp 106 may be formed through several means of manufacture known in the art. In at least one example embodiment, clamp 106 is formed from a single molded product along with wall 108 and base 110. Similar to wall 108 and base 110 described above, clamp 106 and container 104 may be a continuous single molded material. Clamp 106 may be formed from a number of materials well known by those skilled in the art. In a preferred embodiment, clamp 106 is made from a nonpermeable synthetic material such as rubber. Other materials such as polyurethane, polyethylene, polypropylene, polyvinylchloride (PVC) and silicone are also within in the scope of the present invention.

In another related method of manufacture, the clamp or holding or attachment means is separately formed and combined with wall 108 in a subsequent manufacturing process. Although the combination of parts are generally known, it should be appreciated that the attachment means of clamp 106 and wall 108 must be a means that can tolerate heating and cooling without substantial degradation or deformation. Additionally, it should be stated, that although adhesive and chemical welding techniques can be utilized, the fastening means should be non-toxic as the dip/food holder is meant to hold substances that are intended for consumption. If the container is metal, clamp 106 can be magnetic so that it attaches to the container.

Referring now to FIG. 3, clamp 106 is shown with attachment portion 122 which is integrally related to top portion 120. Top portion 120 is generally farther from the exterior surface 108B than the terminal end 124 of attachment portion 122. This feature allows for clamp 106 to securely bind dip holder 103 to a bowl without excess sliding. Attachment portion 122 also may be rigid enough to securely fasten the internal wall 126 of attachment portion 122 to a bowl (such as bond 102) to prevent large amounts of food substrates from getting lodged between clamp 106 and bowl (such as bond 102) when dip holder 103 is in use.

Figure 4:
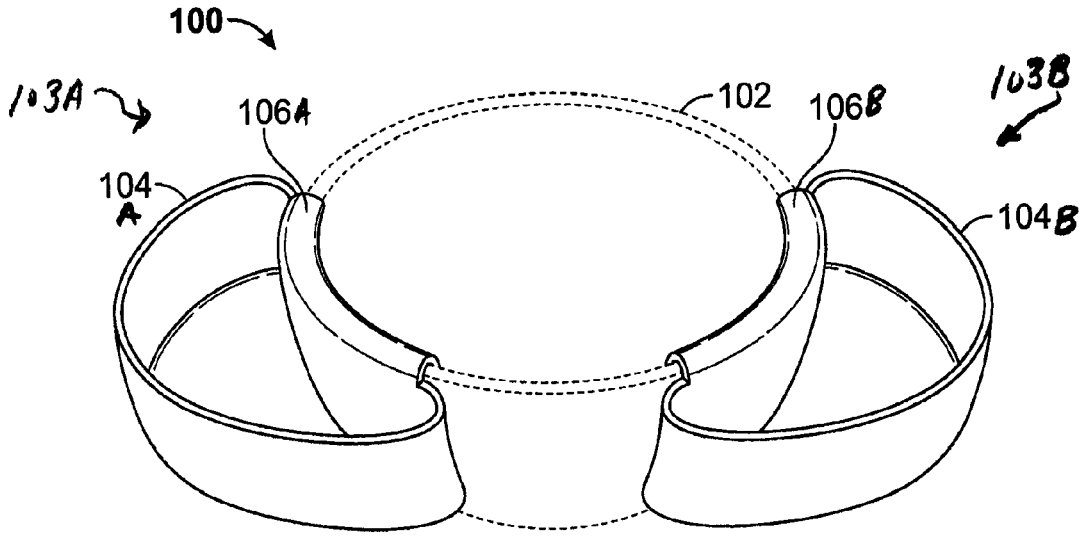
FIG. 4 shows a view of multiple saucers according to the teachings herein.

Referring now to FIG. 4, there is shown multiple containers or holders 103A and 103B adapted to be attached to a bowl 102. In a related embodiment, multiple trays with side clamps can also be used to attach to other trays or plates.

Figure 5:
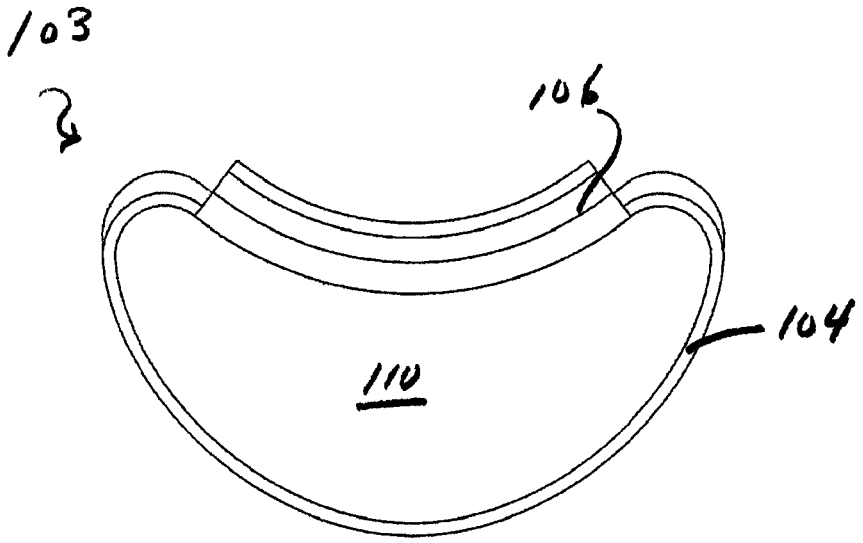
FIG. 5 shows a top elevation view of the saucer.

Referring now to FIG. 5, a top view of dip holder 103, is shown in a generally kidney bean shape. Although no one particular shape is preferred, the shape of the wall and the clamp must be able to securely fasten dip holder 103 to a bowl 102 or dish when in use. Furthermore, the number of clamps and length of the clamp's arc length will be factors in determining a suitable shape for dip holder 103.

The foregoing description is presented to enable one of ordinary skill in the art to make and use the invention and is provided in the context of a patent application and its requirements. Various modifications to the preferred embodiment of the apparatus, and the general principles and features of the apparatus and methods described herein will be readily apparent to those of skill in the art. Thus, the invention is not to be limited to the embodiments of the apparatus and methods described above and illustrated in the drawing figures, but is to be accorded the widest scope consistent with the spirit and scope of the appended claims.

I claim:

1. A food/dip holder assembly comprising:

a container member having an interior surface and an exterior surface forming a wall, said interior surface and said exterior surface terminating at a lip portion; and a clamping means with a substantially arced surface integrally related to said container member, said container having a cooperatively arced surface in a manner to provide the food/dip holder assembly with a means of being removably attached to a serving member, wherein at least a portion of said clamping means is pliable and is securely attached and positioned along an interior surface of said serving member and wherein said serving member is a bowl.

2. The food/dip holder of claim 1 wherein said clamping means and said container member are formed as a single molded product.

3. The food/dip holder of claim 2 wherein said single molded product is made of a material selected from a group consisting of rubber, polyurethane, polyethylene, polypropylene, polyvinylchloride (PVC) and silicone.

4. The food/dip holder of claim 1 wherein the food/dip holder is made of a material selected from a group consisting of rubber, polyurethane, polyethylene, polypropylene, polyvinylchloride (PVC) and silicone, metal, ceramic, glass and reinforced cardboard.

5. The food/dip holder of claim 1 wherein said clamping means is adapted to be coupled to at least a portion of said lip portion.

6. The food/dip holder of claim 1 wherein said clamping means is comprised of one or more clamps disposed on a side of the container member.

7. The food/dip holder of claim 1 wherein said clamping means is selected from the group consisting of a clamp, a clip, a hanger, a curve wire, a fastener and a hook.

8. The food/dip holder of claim 1 wherein said clamping means is coupled to said container member by a mechanism selected from group consisting of adhesives, chemical welding, mechanical fasteners, tongue and groove attachment, and dovetail attachment.

9. The food/dip holder of claim 1 wherein the shape of said lip portion is selected from a group consisting of kidney bean, circular, square, triangular, trapezoidal, ovals and rectangular.

10. The food/dip holder of claim 1 wherein a base of said container member has an additional external layer of skid-resistant material.

11. The food/dip holder of claim 1 wherein said clamping means has a lateral or sideways clamping or clip device configured to removably attach said container member to an edge of said serving member.

12. A food/dip holder assembly comprising:

a serving member configured to support food thereon, said serving member having a lateral edge; and an attachment means adapted to be operatively coupled to said serving member in a manner to provide the food/dip holder assembly with a means of being removably attached to a second serving member, wherein said attachment means is comprised of a lateral or sideways clamping or clip device configured in an arc similar to an outer wall portion of said second serving member; said lateral or sideways clamping or clip device configured to removably attach said serving member to an edge of said second serving member having a food surface and an opposed non-food surface and wherein at least a portion of said clamping or clip device is positioned upon the food surface of said second serving member.

13. The food/dip holder of claim 12 wherein said attachment means is selected from the group consisting of a clamp, a clip, a hanger, a curve wire, a fastener and a hook.

14. A kit for serving various foods in various serving dishes comprising a serving member having an attachment means is pliable and operatively coupled thereto, wherein said attachment means is integrally related and configured to removably attach said serving member to a second serving member wherein said attachment means is configured in an arc similar to an outer wall portion of said second serving member and wherein at least a portion of said attachment means positioned along an interior surface of said serving member.

15. The kit of claim 14 wherein multiple serving members are provided with attachment means such that the serving members are configured to fit with each other for ease of storage and portability.

16. The kit of claim 14 wherein said attachment means is comprised of a lateral or sideways clamping or clip device configured to removably attach said serving member to an edge of said second serving member.

* * * * *